US005340026A

United States Patent [19]

Woodruff

[11] Patent Number: 5,340,026

[45] Date of Patent: Aug. 23, 1994

[54] FLUID SPRAYING APPARATUS

[75] Inventor: Byron J. Woodruff, Santa Clara, Calif.

[73] Assignee: Paint Trix Inc., Sunnyvale, Calif.

[21] Appl. No.: 152,979

[22] Filed: Nov. 15, 1993

[51] Int. Cl.[5] ..... B05B 1/28

[52] U.S. Cl. ..... 239/104; 239/526

[58] Field of Search ..... 239/525, 526, 288, 288.5, 239/104

[56] References Cited

U.S. PATENT DOCUMENTS

| | | | |
|---|---|---|---|
| 2,251,719 | 8/1941 | Sapp | 239/150 X |
| 2,317,288 | 4/1943 | McCubben | 239/150 |
| 2,842,093 | 7/1958 | O'Neill | 239/288.3 X |
| 3,036,550 | 5/1962 | Remington et al. | 118/301 |
| 4,715,537 | 12/1987 | Calder | 239/288.3 X |
| 4,974,532 | 12/1990 | March | 118/301 |
| 5,009,369 | 4/1991 | Iwaszkowiec | 239/223 |
| 5,148,988 | 9/1992 | Smrt | 239/150 |

FOREIGN PATENT DOCUMENTS 1456411 11/1976 United Kingdom .

*Primary Examiner*—Andres Kashnikow

*Assistant Examiner*—Kevin P. Weldon

*Attorney, Agent, or Firm*—Schneck & McHugh

[57] ABSTRACT

A fluid spraying gun having a disk-shaped shield positioned adjacent to a spray of fluid at an adjustable angle. The shield has a sharp edge that can roll on a surface for creating a sharp border between an area exposed to spray and an area concealed from spray. The shield also has a rounded rim on a face distal to the spray for sliding along a surface transverse to the surface the edge rolls on, allowing the formation of a sharp border along a corner between the surfaces or the positioning of the spray a set distance from the transversely oriented wall. A lip rings a face adjacent the spray for catching excess spray prior to the edge, a tip of the lip aligned between an orifice where the spray originates and the edge. The shield is connected to the gun via a shaft which can pivot about an axis near the orifice, such that the tip and the edge remain aligned with the orifice at a variety of angles. The shaft may have an adjustable length that maintains that alignment, and the shield and shaft can be used as a guide for positioning the orifice a uniform distance from a surface, in order to uniformly coat the surface with fluid.

20 Claims, 2 Drawing Sheets

FLUID SPRAYING APPARATUS

DESCRIPTION

Technical Field

The present invention relates generally to apparatus for spraying fluid and more particularly to shields for sprays of fluids such as paint.

Background Art

The need for providing shields while painting is well known. Masking tape, for example, is named for its ability to mask a surface. A difficulty encountered with masking tape is that care must be taken during its application, which increases painting time. Also, due to the limited width of the tape, care must also be taken during painting to avoid surpassing a border formed by the tape, or additional materials must be attached to the tape, both approaches requiring extra work.

In certain automated applications, such as the painting of automobile bodies or soft drink cans, rolling shields have been used to demark a border of paint being sprayed on a surface. In U.S. Pat No. 3,036,550, Remington et al. teach of a spray coating machine for painting containers as they roll down an assembly line. Similarly, U.S. Pat No. 4,974,532 to March teaches of an apparatus for spray coating a first portion of a workpiece with a coating material while masking a second portion of the workpiece bordering on the first portion with a rotating mask.

Also known are pairs of rollers bordering a spray nozzle, so that liquid sprayed from a nozzle is contained within the rollers as they roll on a surface to form a stripe of uniform width. Examples of such devices are contained in G B Pat No 1 456 411 to Duree and U.S. Pat. No. 5,148,988 to Smrt.

Masking of fluid sprays can also be advantageous to protect an operator, as well as a surface, from the fluid. In U.S. Pat. No. 5,009,369, Iwaszkowiec teaches of a rotating spray shield mounted on a hub of a sprayer for spraying herbicides.

An object of the present invention is to provide a shield for a fluid sprayer that creates a sharp border on a surface between an area exposed to spray and an area shielded from spray.

Another object is to provide a shield that can create such a sharp border even in corners between surfaces.

A further object is to provide a shield that can be adjusted relative to the spray to allow for sprays that fan out differently and for varying borders.

Yet another object is to provide a guide for positioning a spray a set distance from a surface.

SUMMARY OF THE INVENTION

The present invention accomplishes the above objects by providing a spray gun with a disk-shaped shield that is positioned adjacent to a spray of fluid such that the shield intercepts the spray to define a border of the spray. The shield has a sharp edge and can rotate so that the edge can roll on a surface for demarking a sharp border on a surface such as a wall. The shield has a rim on the face away from the spray that is gently curved, allowing the rim to slide along a surface transverse to the first surface, such as a wall perpendicular to the first wall, while the sharp edge rolls along a corner between the walls. Rolling the shield on a surface also affords a means for positioning the spray gun a set distance from the surface for uniform coating of the surface.

A lip rings the inner face, connected to the inner face near the perimetrically disposed edge and projecting radially inward, the lip splayed away from the face to terminate in an annular tip. The tip is aligned between an orifice from which the spray originates and the edge, so that the lip intercepts excess spray prior to the edge, the tip augmenting the demarcation of the edge.

The shield is attached to the gun by a shaft which can adjust the angle from the axis of the spray at which the spray is intercepted by the edge and lip. In order for the tip and the edge to remain aligned with the trajectories of the spray, the shaft is able to pivot about an axis which is aligned with the orifice. A nozzle or a series of nozzles may be provided that can adjust the degree of divergence of the spray about a spray axis, allowing different coating speeds and densities.

BEST MODE FOR CARRYING OUT THE INVENTION

Figure 1:
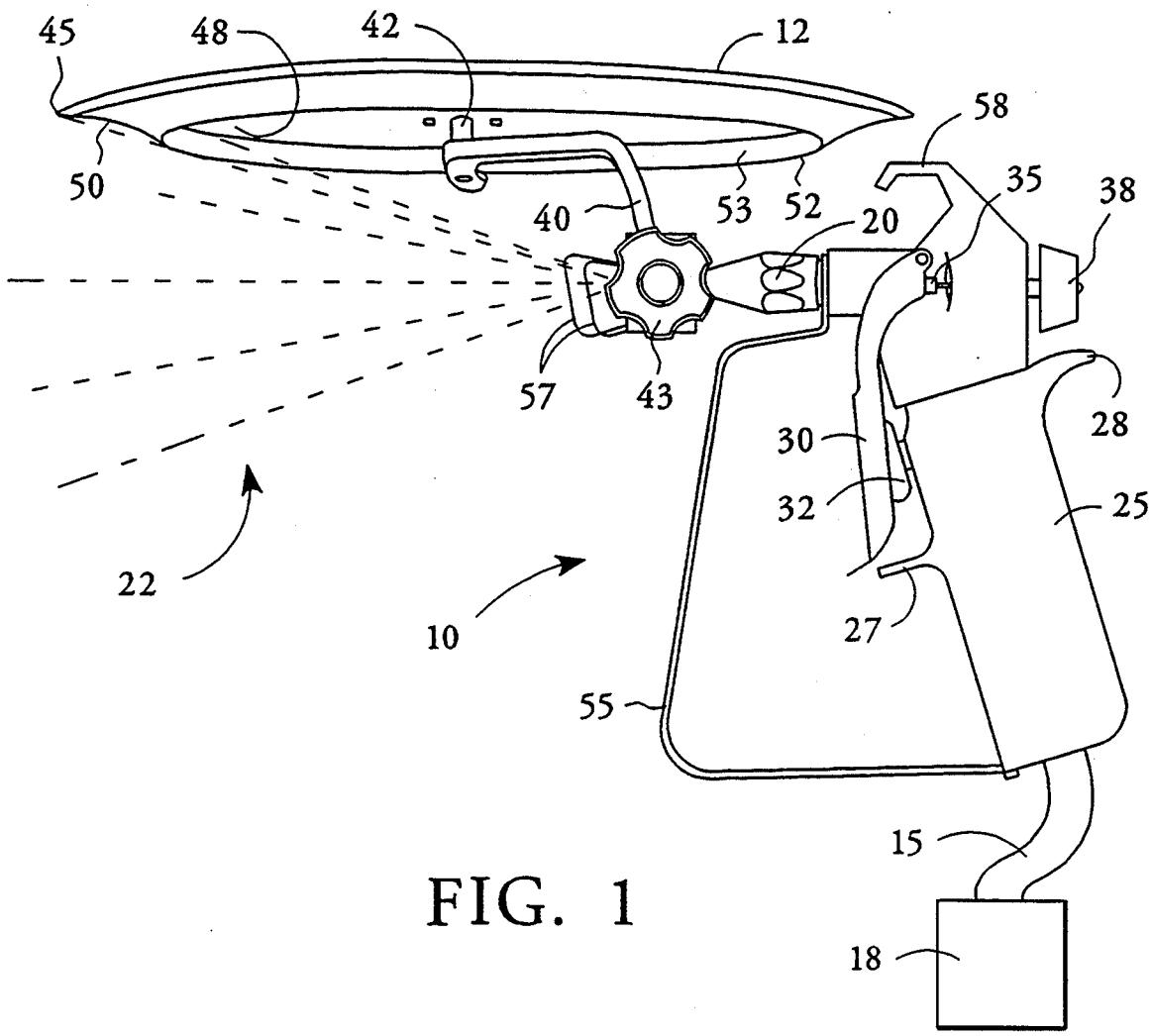
FIG. 1 is a perspective view of a side of the spray gun and shield of the present invention.

The hand held fluid spray gun 10 of the present invention is shown in FIG. 1 to be pointing to the left, with a generally disk-shaped shield 12 disposed above the gun 10. Attached to the gun 10 from below is an inlet conduit 15 which provides fluid communication with a pressurized source of fluid 18- Attached to an opposite end of the gun 10 is a nozzle 20, from which a spray of fluid 22 can shoot forward. The gun 10 has a grip 25 to facilitate holding the gun 10 by a hand of an operator, not shown, the grip having a front projection 27 and a rear projection 28 which provide support for the hand holding the gun 10. Disposed above the front projection 27 is a trigger 30 in a position for operation by an index finger of an operator while other fingers of the operator hold the grip 25 below the front projection 27.

The trigger 30, when unperturbed, is held away from the grip 25 by a spring loaded stop 32. When the trigger 30 is pushed inward as shown in FIG. 1, however, the stop 32 is pressed against the grip 25, and the trigger pushes a push rod 35, which in turn opens a valve, not shown. The valve controls whether the pressurized fluid can flow through the gun 10. With the trigger depressed as shown, the valve is opened and the spray of fluid 22 shoots from the nozzle 20. A flow adjustment knob 38 can be rotated to adjust a size of an interior passage, not shown, and thereby control a rate of flow of the fluid during a period when the valve is open.

Attached to the nozzle 20 is a shaft 40 which is in turn attached to a central axis 42 of the shield 12. A knob 43 can be tightened to hold the shaft 40 at a fixed angle relative to the gun 10, loosened to adjust that angle or removed to allow the removal of the shaft 40 and shield 12 from the gun 10. The shield 12 can be seen to have a sharp edge 45 disposed at its perimeter. The sharp edge 45 allows the shield to demark a sharp border of the spray 22 on surfaces being sprayed by rolling the edge 45 on those surfaces, the sharp edge providing an exact delineation between the area to be sprayed and the area to be masked from spray. The sharp edge 45 can also fit into tight spots such as corners between walls for which masking is commonly both necessary and difficult, the sharpness of the edge 45 allowing spray to coat essentially all of one of the walls and yet completely mask the other wall.

Attached near the perimetrically disposed edge 45 to a concave inner face 48 of the shield 12 is an annular lip 50 which projects radially inward and curves away from the inner face 48, terminating in a tip 52. The lip 50 intercepts excess spray before that spray can contact the edge 45, allowing the edge 45 to be free from fluid drippings that could otherwise mar a border between the areas sprayed and masked. An optional removable fluid absorption ring 53 is shown disposed between the lip 52 and the tuner face 48. This ring 53 may be composed of materials such as sponge or cloth which are known to absorb and hold liquid. For many fluids, such as some paints, the tapered space between the lip 52 and the inner face 48 acts to retain fluid sufficiently without the use of ring 53.

Several guards are positioned about the gun 10 for protection of various parts. A hand guard 55 formed of metal wire or like materials provides protection for the hand holding the gun, the guard attached to the gun 10 near the nozzle 20 and near the inlet conduit 15 and projecting forward of the grip 25. A pair of similar wires form a nozzle guard 57, which project forward and to the outside of the nozzle 20, for protecting that device while allowing the spray 22 to pass unobstructed. A top guard 58 protects a top end of the gun from damage.

Figure 2:
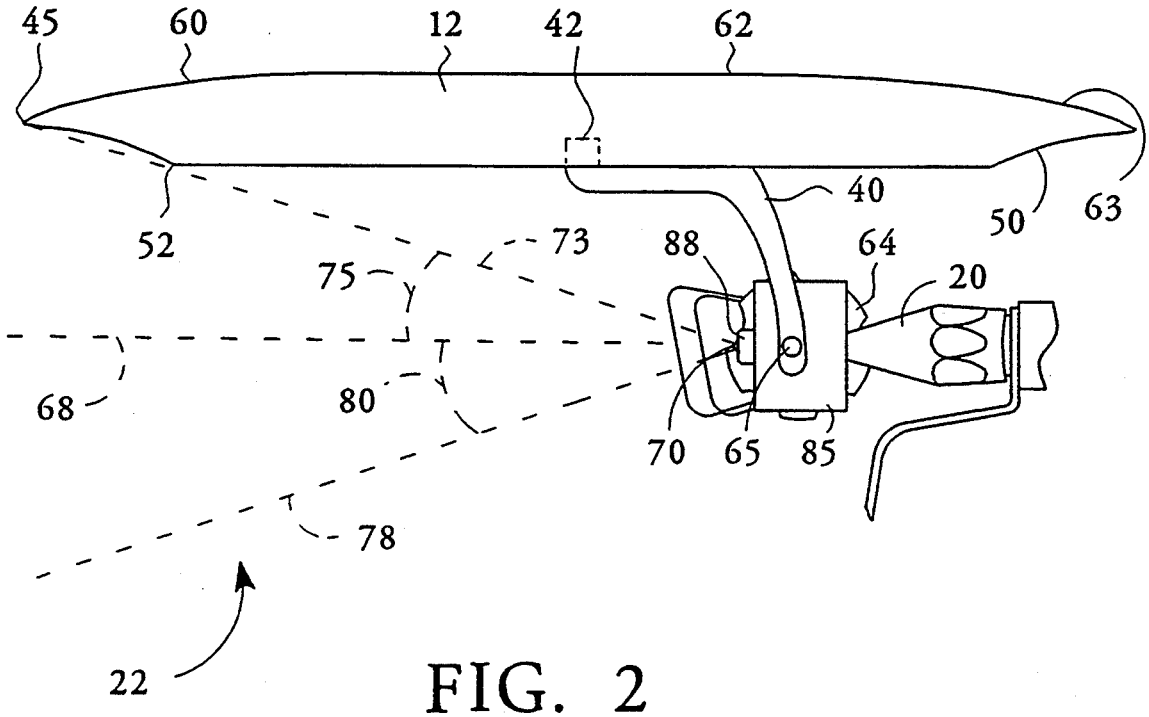
FIG. 2 is an enlarged side view of the shield, shaft and nozzle of FIG. 1.

Referring now to FIG. 2, an enlarged side view of the shield shows that an outer face 60 of the shield 12 is generally slightly convex over a relatively large central area 62 of that face 60, being generally flat near a center of that face aligned with the central shield axis 42 and curving more dramatically at a perimetrically disposed rim 63. In general, the outer face 60 can be seen to curve parabolically. This gradual curvature that becomes more pronounced at the rim enables the shield 60 to be angled into a corner where walls meet, the outer face sliding along the wall surface to be masked. This sliding or sledding of the outer face 60 creates a more uniform border, as the effect of perturbations or protuberances along the wall being masked on the path of the shield are smoothed out by the area of the outer face 60 as it slides over those imperfections. The parabolic curvature of that face 60 allows this sledding action to occur at various angles that the shield 12 can be pushed into the corner.

The knob 43 has been removed in FIG. 2 to show the means of mounting the shaft 40 on the nozzle 20, although parts of an opposing knob 64 can be seen behind the nozzle 20. An end of the shaft 40 can be seen to be pivotally attached to the nozzle via a bolt 65, which allows angular adjustment of the location of the shaft 40 and shield 12 relative to a spray axis 68. The spray axis 68 is an imaginary line about which the spray 22 is generally centered. The spray 22 shoots out of a typically circular orifice 70 at a front end of the nozzle 20.

The orifice 70 can be seen to be generally aligned with parts of the edge 45 and the tip 52 that are furthest from the orifice 70 along imaginary line 73. In this manner, excess spray that shoots from the orifice 70 along a trajectory that is angled further from the spray axis 68 than imaginary line 73 will be caught by the lip 50. Spray having a trajectory that is generally along line 73 will be intercepted by edge 45 to define a sharp border of the area exposed to spray. Since the axis of the bolt 65 about which the shaft can pivot is generally aligned with the orifice 70 at an orientation generally perpendicular to both the shield axis 42 and the spray axis 68, the furthest parts of the tip 52 and edge 45 remain in alignment along imaginary line 73 at various angles 75 between line 73 and spray axis 68.

On sides of the spray 22 not bordered by the shield 12, the spray may diverge further from the axis 68, as shown by outer trajectory 78, which diverges from the spray axis 68 by an angle 80. In general, the angular distribution or density of the spray may be Gaussian, so that the spray does not really end at outer trajectory 78 but rather fades out gradually near that trajectory. The shape of the orifice 70 is a primary factor in determining the distribution of the spray. For example, given a constant amount of fluid pressure, a larger circular orifice 70 will produce a less divergent spray. An enlargement of orifice 70 can occur over time due to use that tends to bore out the orifice 70. The angular adjustability of the shield 12 is important to allow for this common variation in spray divergence. On the other hand, the gun 10 of the present invention may come equipped with a orifice 70 that is adjustable, in order to allow the spray divergence to be tailored to a particular application. An orifice 70 may also be provided that is generally annular rather than circular in shape, which can provide a more uniform distribution of spray within the outer trajectory 78.

The shield 12 is of a shape and position relative to the spray 22 that offers additional advantages. Both the shield 12 and the shield axis 42 are positioned generally forward of the orifice 70, to allow the shield to be of a relatively small size and light weight. The small size is advantageous in maneuvering the shield 12, especially around corners or other surface variations. The light weight is helpful in mitigating fatigue of the operator.

The generally disk-shaped shield can be seen to provide a symbiotic efficiency in intercepting the generally Gaussian or circular distribution of spray for the mapping of a linear border on a flat surface. In other words, an outer trajectory 78 which would impinge upon a generally planar surface in a given direction along the surface from the intersection of the spray axis 68 may be intercepted by a part of the edge 45 furthest from the orifice 70, while the impingement of other outer trajectories 78 on the surface do not extend as far in that surface direction, and are not intercepted by edge 45 due to the curvature of that edge. For a generally circular shield 12 having a central axis 42 oriented generally perpendicular to the spray axis 68 of generally circularly symmetric diverging spray, this relationship works well when a shield radius, which is a distance from the shield axis 42 to the edge 45, is approximately equal to a spray radius, which is the distance along the surface being sprayed between the intersection of the generally normal spray axis 68 and the outer trajectory 78 in the absence of interception by the edge 45. It is interesting to note that this efficient mapping occurs even if the axis 68 of the spray is not normal to the planar surface.

Given a shield axis that perpendicularly intersects a spray axis, as long as the shield radius is at least as large as the spray radius, the edge provides a thorough masking of the spray at a border. Lightness and maneuverability of the shield, however, are benefited by a smaller shield radius. These goals are sought to be balanced in the present invention by having a shield 12 with a shield radius that is similar to a typical spray radius.

A rectangular block 85 is shown in FIG. 2 affixed to the nozzle 20. This block 85 can be used to adapt a common fluid spray gun 10 so that the shaft 40 and shield 12 can be attached. To accomplish this adaptation, a replaceable nozzle tip 88 is removed from a nozzle 20 of such a gun 10, and the block 85 is screwed onto the nozzle 20 in its place. The nozzle tip 88 is then screwed onto an opposite side of the block 85, the block having an internal passageway, not shown, that allows fluid to travel from the nozzle 20 through the block 85 and exit out the orifice 70 contained in the nozzle tip 88.

Figure 3:
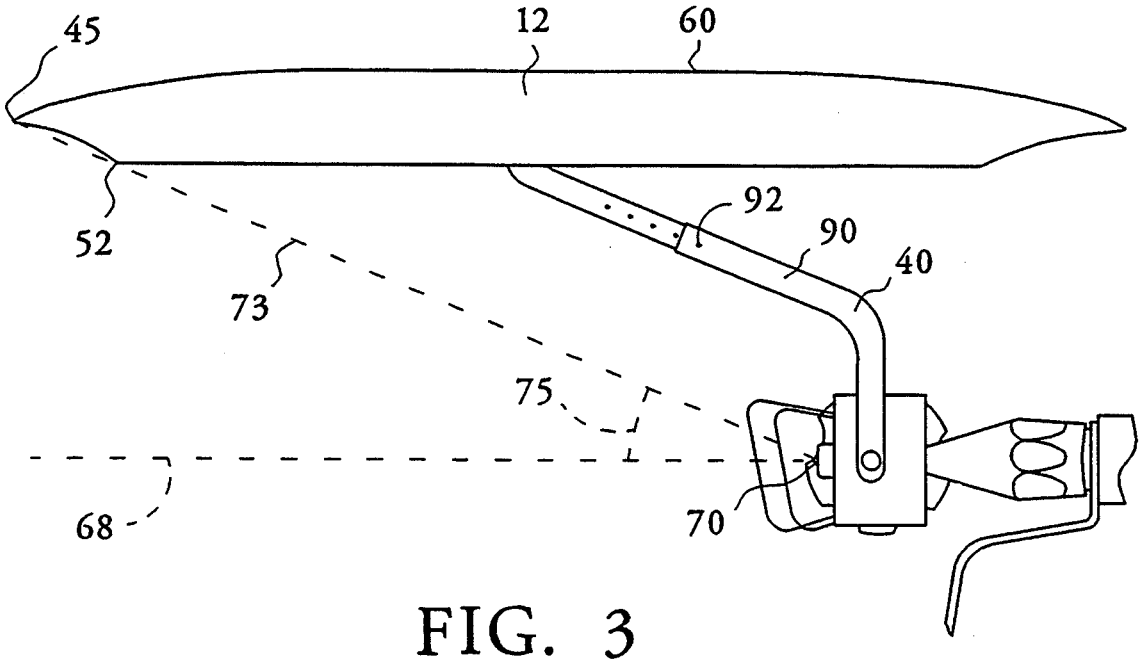
FIG. 3 is a side view of an embodiment of the present invention having a shaft of adjustable length.

FIG. 3 shows an embodiment of the present invention with a shaft 40 that has a middle section 90 of adjustable length. The middle section 90 can be seen to be generally straight and parallel to the line 73 from the orifice 70 that is tangent to the parts of both the edge 45 and the tip 52 that are furthest from the orifice 70. The middle section 90 is shown to have a telescopic shape that locks in place with a pin 92, but any known means of adjusting the length of the middle section 90 could alternatively be employed.

Since the middle section 90 is generally parallel to the line 73, changing a distance of the orifice 70 from a surface can be accomplished independently of changing the angle 75 between line 73 and spray axis 68. This feature highlights an additional function of the present invention; that of providing an easy and accurate means of guiding a spray gun a set distance from a surface to produce a uniform coating on the surface. The outer face 60 of the shield 12 can also be used, in this regard, for positioning the spray away from a corner between transverse surfaces, without regard to using the shield to form a sharp border.

Figure 4:
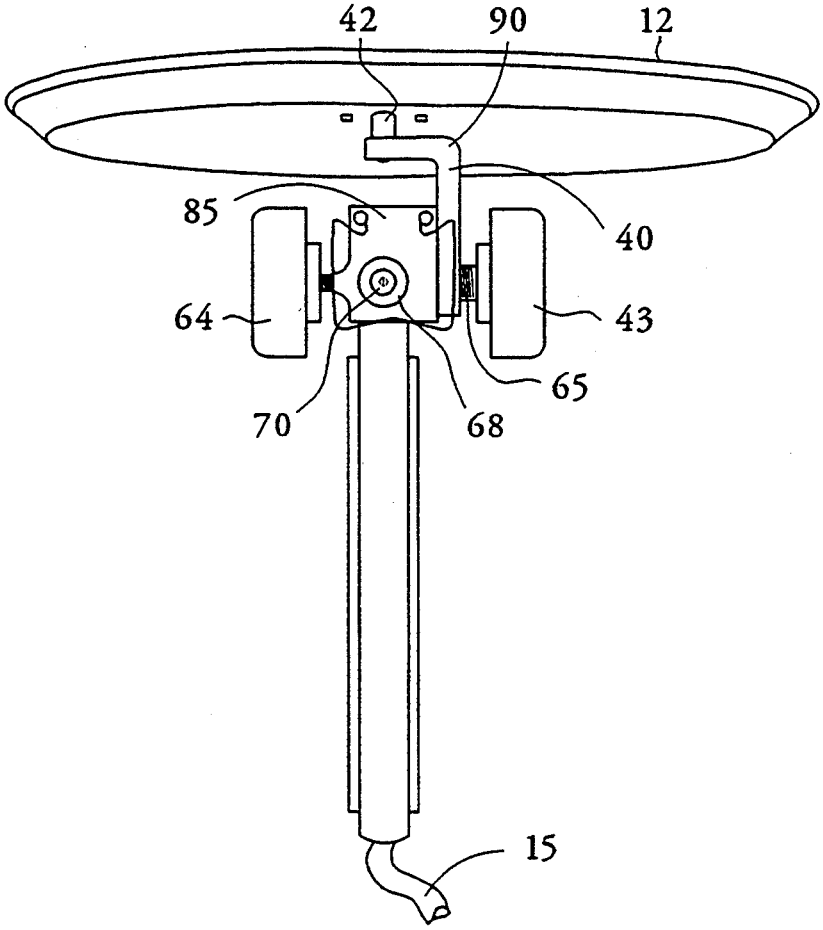
FIG. 4 is a front view of the spray gun and shield of FIG. 1.

Referring now to FIG. 4, the shaft 40, which is mounted on one side of the block 85 via the bolt 65, has a bend 90 that aligns the shield axis 42 with the spray axis 68, which in this front view perspective appears to be superimposed on the orifice 70. The generally balanced structure and weight of the invention, which allow for ease and efficiency of operation, are evident in this view. The shield can be seen to be disposed oppositely to inlet conduit 15, to allow insertion of the shield into areas such as corners between walls.

The present invention can be used for various applications that may be performed with fluid sprayed from a gun. A particular use is in spray painting, in which case the ability of the shield 12 to quickly and easily provide an exact border in areas such as corners between walls can be a great advantage.

I claim:

1. A fluid spraying apparatus comprising:

a hand held fluid spray gun having a fluid inlet in fluid communication with an outlet orifice, a means for supplying a pressurized fluid to said inlet, such that said fluid shoots from said orifice in a divergent spray generally centered about a spray axis, a generally disk-shaped shield rotatable about a central shield axis, said shield supported from the gun in a position adjacent to said spray, whereby said shield intercepts said spray to define a border of said spray, and a shaft having a first end and a second end, said first end connected to said shield axis and said second end pivotally connected to said gun near said orifice, said shaft having a free state in which said shaft can pivot toward and away from said spray axis, said shaft also having a fixed state in which said shaft is fixedly disposed relative to said spray axis.

2. The apparatus of claim 1 wherein said shield has an inner face proximate to said spray and an outer face distal to said spray, said inner face connected to said outer face at a sharp, perimetrically disposed edge, a part of said edge distal to said orifice aligned to intercept said spray, whereby said edge can roll along a surface to accurately define said border of said spray on said surface.

3. The apparatus of claim 2 wherein said outer face has an arcuate rim which is perimetrically curved toward said spray, whereby said rim may slide along a surface oriented transversely to said surface said edge can roll along, with said edge disposed in a corner between said surfaces to accurately define said border of said spray along said corner.

4. The apparatus of claim 2 wherein said inner face is concave and has an arcuate lip connected near said edge, said lip projecting radially inward and curved away from said inner face and terminating in an annular tip, said tip aligned between said orifice and said part of said edge distal to said orifice, whereby said lip further demarks said border by intercepting excess spray shooting from said orifice toward said edge.

5. The apparatus of claim 1 wherein said shield is disposed substantially forward of said gun and said shield intercepts said spray at a location where a diameter of said spray which is oriented generally normal to said spray axis is many times greater than a diameter of said orifice, whereby said shield may be small and lightweight, said edge defining a border of said spray while said spray coats a large surface area.

6. The apparatus of claim 2 wherein said shield has a radius of a similar length to a radius of said spray on a surface said edge can roll along which is oriented generally normal to said spray axis.

7. The apparatus of claim 1 further comprising a hand operable trigger controlling a valve disposed within said gun, said valve having an open state allowing fluid communication between said inlet and said orifice and having a closed state obstructing fluid communication between said inlet and said orifice, whereby said spray may be turned on and off.

8. The apparatus of claim 1 wherein said shield has an edge at a perimeter and has a lip adjacent said spray and connected near said edge, said lip projecting radially inward, curving away from said shield and terminating in an annular tip, and wherein said orifice, a portion of said edge and a portion of said tip are generally aligned.

9. The apparatus of claim 1 wherein said shaft is extendable in length along a direction generally aligned with said orifice.

10. In a fluid spraying apparatus having a gun supplied with a pressurized fluid that shoots from an orifice in said gun in a divergent spray generally centered about a spray axis, an improvement comprising:

a generally disk shaped shield rotatable about a central shield axis, said shield disposed adjacent to said spray, whereby said shield intercepts said spray to define a border of said spray, and a shaft having a first end and a second end, said first end connected to said shield axis and said second end pivotally connected to said gun by a pivot pin with a major axis oriented generally normal to said shield axis and disposed near said orifice, said shaft having a free state with the shaft pivoting about said pin and said shaft having a fixed state relative to said pin.

11. The improvement of claim 10 wherein said shield has an inner face proximate to said spray and an outer face distal to said spray, said inner face connected to said outer face at a sharp, perimetrically disposed edge, whereby said edge can roll along a surface to accurately define said border of said spray on said surface.

12. The improvement of claim 11 wherein said outer face has an arcuate rim which is perimetrically curved toward said spray, whereby said rim may slide along a surface oriented transversely to said surface said edge can roll along, with said edge disposed in a corner between said surfaces to accurately define said border of said spray along said corner.

13. The improvement of claim 11 wherein said inner face is concave and has an arcuate lip connected near said edge, said lip projecting radially inward, curved away from said inner surface and terminating in an annular tip, said tip aligned between said orifice and a part of said edge distal to said orifice, whereby said lip further demarks said border by intercepting excess spray shooting from said orifice prior to interception by said edge.

14. The improvement of claim 10 wherein said shield is disposed substantially forward of said nozzle and said shield intercepts said spray at a position where said spray has diverged from said spray axis a distance many times greater than that of a diameter of said orifice.

15. The improvement of claim 13 further comprising a means for removing said fluid from between said lip and said inner face.

16. An apparatus for positioning a divergent spray of fluid on a surface comprising:

a hand held fluid gun having an inlet and an outlet, a means for supplying a pressurized fluid to said inlet, a nozzle attached to said gun in fluid communication with said outlet and directing said fluid out of an orifice in a divergent spray generally centered about a spray axis, a generally disk shaped shield rotatable about a shield axis, said shield disposed adjacent to said spray, whereby said shield intercepts said spray to define a border of said spray, and a shaft having a first end and a second end, said first end connected by a pivot to said gun near said nozzle and said second end connected to said shield axis, said shaft having a free state in which said shaft can rotate about a longitudinal axis of said pivot which intersects and nozzle at an angle substantially normal to said spray axis, said shaft also having a fixed state in which said shaft is fixedly disposed relative to said nozzle, whereby said shaft and said shield define a distance separating said nozzle from said surface by rolling said shield on said surface with said spray axis at an angle to said surface.

17. The apparatus of claim 16 wherein said nozzle has a means for adjusting an angle of divergence of said spray from said spray axis.

18. The apparatus of claim 16 wherein said shield has an inner face proximate to said spray and an outer face distal to said spray, said inner face connected to said outer face at a sharp, perimetrically disposed edge, said outer face having an arcuate rim which is perimetrically curved toward said spray, whereby said edge can roll along said surface to accurately define said border of said spray on said surface, and said rim can slide along a surface oriented transversely to said surface said edge can roll along, with said edge disposed in a corner between said surfaces to accurately define said border of said spray along said corner.

19. The apparatus of claim 18 wherein said inner face is concave and has an arcuate lip connected near said edge, said lip projecting radially inward, curved away from said inner surface and terminating in an annular tip, said tip aligned between said orifice and a part of said edge distal to said orifice, whereby said lip further demarks said border by intercepting excess spray prior to said edge.

20. The apparatus of claim 18 wherein said shaft has a middle section that is generally parallel to a line between said orifice and a part of said edge distal to said orifice, said middle section having an adjustable length, such that said distance between said surface and said nozzle can be adjusted independently of an angle between said shield and said spray axis by changing said length of said middle section.

* * * * *